United States Patent [19]

Laehy et al.

[11] 4,270,873

[45] Jun. 2, 1981

[54] PIVOTABLE DELINEATOR POST

[75] Inventors: Peter Laehy; Stefan A. Dag, both of Aspen, Colo.

[73] Assignee: Rapidgate, Inc., Aspen, Colo.

[21] Appl. No.: 29,737

[22] Filed: Apr. 13, 1979

[51] Int. Cl.[3] ..... E01F 9/00

[52] U.S. Cl. ..... 404/10; 256/1; 40/612

[58] Field of Search ..... 404/10, 11, 9; 256/13.1, 1; 40/612; 116/63 R

[56] References Cited

U.S. PATENT DOCUMENTS

| | | | |
|---|---|---|---|
| 1,282,673 | 10/1918 | Brakey | 256/1 X |
| 1,408,636 | 3/1922 | Power | 256/1 X |
| 1,599,928 | 9/1926 | Sweeney | 256/13.1 X |
| 1,897,250 | 2/1933 | Frei | 256/1 |
| 1,903,683 | 4/1933 | Nute | 256/1 X |
| 2,141,067 | 12/1938 | Miller | 404/10 X |
| 3,693,940 | 9/1972 | Kendall | 256/1 |

FOREIGN PATENT DOCUMENTS

| | | | |
|---|---|---|---|
| 236435 | 3/1964 | Austria | 404/10 |
| 6404220 | 10/1964 | Netherlands | 404/10 |

*Primary Examiner*—Nile C. Byers, Jr.
*Attorney, Agent, or Firm*—Sheridan, Ross, Fields & McIntosh

[57] ABSTRACT

A delineator pole is provided which pivots when a force is applied thereto and returns to its original position upon release of the force. The pole includes upper and lower segments with a biasing spring completely housed within the lower pole segment which is held in a support structure. The upper and lower pole segments are joined together by the spring and are held in axial alignment by the mating cooperation of a rounded edge lip portion adjacent the lower pole segment and a rounded grooved flange adjacent the upper pole segment. Whenever the upper and lower pole segments are moved out of axial alignment, the force of the spring together with the rounded edge lip portion and the groove of the flange interact to guide the segments back into axial alignment.

5 Claims, 3 Drawing Figures

PIVOTABLE DELINEATOR POST

TECHNICAL FIELD

This invention relates to delineator posts for use in marking boundaries, supporting signs and more particularly to posts which are constructed to facilitate a break over motion of the upper portion of the post upon impact by a vehicle, animal, or human body, including a downhill skier, so that injury or damage to the body or vehicle and to the post are minimized.

BACKGROUND ART

Highway signs are usually susceptible to damage or destruction when struck by a vehicle and are usually of metal which may inflict comparable damage on the striking vehicle. Straightening of the post is usually uneconomical and costly replacement is the usual remedy.

Either in a highway or sporting context, the information provided by the sign after it has been knocked down or broken by impact is no longer available and this usually constitutes a substantial safety hazard.

Slalom ski gates currently available are generally rigid poles made of bamboo or other lightweight substances which will break or easily be uprooted from the snow upon impact so as not to harm the skier. These uprooted poles and fragments constitute a hazard to other skiers and necessitate a system of constant vigilence and replacement which is costly as well as dangerous.

In an attempt to obviate the need for complete replacement and to reduce the damage to both the post and the body impacting the post, a number of structures have been proposed which break over or yield upon impact. Several types of delineator posts have been tried which have frangible sections which sheer away under impact, however, such devices still do not avoid or overcome the need for replacement but merely are helpful in reducing the damage sustained by the vehicle striking the delineator post.

PRIOR ART STATEMENT

One type of structure which relies upon yielding or pivoting of an upper section of the post by the bending of a connecting bolt is that structure shown in U.S. Pat. No. 3,820,906 to Katt. In the Katt structure, impact to the upper portion of the post results in severance of the frangible plate along the sheer line followed by elongation and bending of a bolt used in supporting the upper portion of the post on a ground post or a lower section of the delineator post. It will be apparent that this structure does yield under impact and results in less damage to the upper portion of the post, which is struck by the vehicle, than a rigid post. Nevertheless, repair and even replacement of the articulation affording portions of the post before the upper portion of the post can be placed back in service is often required. Further, the metallic and irregular surface of the post would be likely to inflict severe damage upon a human or animal body even though it might ultimately give away under this type of impact.

A boundary marker adapted to return to the vertical position after being struck by a vehicle is disclosed in U.S. Pat. No. 3,279,133 to DeKorte. This device comprises a hollow upper and lower pole section which are joined by means of an external spring which is threaded onto both upper and lower sections. When the pole is struck the spring itself flexes allowing the upper pole to pivot at ground level and return to the vertical. This device comprises a number of separate parts including plugs to close off the top and bottom of the upper pole, as well as the very bottom of the underground section of the pole, and an underground sheath. This multiplicity of parts is recognized as a problem and cementing the parts together is recommended in that disclosure. A further disadvantage of this device is that the spring itself bends and thus is liable to become distorted upon continued use. Furthermore, at ground level the spring is external to the device and susceptible to corrosion and impairment of function due to clogging from such substances as dirt and ice.

Another similar device is disclosed in U.S. Pat. No. 2,286,959 to Haines which discloses a sign post incorporating a lower pipe section. Housed within rings is a helical spring which is under tension whenever the upper pipe section is moved out of vertical alignment. Upon release of the force which causes this misalignment, the spring returns to its compressed state thereby returning the upper pipe section to vertical alignment with the lower pipe section. This device is made of metal and again has the disadvantage of incorporating a spring which bends, thereby becoming subject to distortions upon repeated impact. The separable rings are subject to misalignment and, when out of alignment or distorted by impact, the crevices between the rings would allow dirt, ice, and corrosive substances to attack the spring.

The device disclosed in U.S. Pat. No. 1,939,968 to Frei is specifically adapted for embedding in a concrete base. The post itself is made of a tubular, resilient, water-proof casing within which a coil spring is disposed and through the center of which runs a metal cable. The upper end includes a cap which is detachably secured to a polygonal bushing or plug by means of which the pressure applied by the cap upon the coil spring and tubular casing may be vaired thereby permitting the tension of the coil spring to be adjusted. The upper end of the inner metal cable is soldered to the polygonal bushing and the outer circumference of the bushing frictionally retains the coil spring to prevent relative rotation thereof. Since the upper end of the cable is soldered to the polygonal bushing it can be readily seen that the adjustment of the spring is only possible over the distance permitted by the width of the bushing and the height of the casing. This device has the disadvantage of many separate parts as well as having the spring itself bend upon impact, thus subjecting it to possible distortion. Also the flexible casing material is subject to abrasion both from within by the spring and from without by the impacting body, which might tend to shorten the like of the post in high-impact areas.

In U.S. Pat. No. 3,799,686 to Williams a resiliently bendable road marker is disclosed comprising a plurality of resilient hard rubber post portions which are united by an elongated flexible core element formed of a steel cable. This device is not designed to bear a visual sign, but rather to provide an audible signal by scraping against a vehicle and is designed to break into its component parts upon excessive impact.

U.S. Pat. No. 4,032,248 to Parduhn, et al. describes a post having a ground post member, a support post member, and a resilient tubular sleeve joining the two post members together. In addition to wear and tear on the resilient sleeve material, the chief disadvantage of this device is the fact that it pivots only along the axis of the pivot pin.

In U.S. Pat. No. 2,976,000 to Gunderson a rigid stake driven into the ground is shown with a resilient shank connected to the stake for supporting a sign. The shank includes an outer spring surrounding an inner wire to return the shank to a vertical position whenever the shank is moved out of vertical alignment. In addition to the disadvantage of having the spring itself destroyed upon impact, it lies exposed to the elements and the use of a clamp to join the upper and lower segments results in an unbalanced appearance while the clamp itself is an irregular metallic protuberance capable of inflicting damage to the impacting body.

In U.S. Pat. No. 3,875,720 to Russell a sign post is depicted having a ground attached lower section and a separate upper section joined together by a plurality of juxtaposed resilient metal rods. These rods are bundled together by means of two U-bolts and slide relative to each other upon impact, allowing the pole itself to flex. The degree of flexibility is not as great as might be desired and the potential of these metal rods for significant damage to the impacting body appears to be higher than desirable.

SUMMARY OF INVENTION

In accordance with this invention, a pole having an upper segment and a lower segment pivotably joined together is provided. A spring biasing structure is wholly contained within the pole lower segment which is held in a support structure. The spring is operably connected to the pole upper segment so that upon forceable impact the pole upper segment pivots against the force exerted by the spring bias. Upon release of the force, the spring returns the pole upper segment to its original position.

More particularly, a delineator pole is provided which includes a lower segment completely held in a support structure such as ground, snow, or cement. The pole lower segment has a tapered tip connected at its bottom to ease its insertion into the support structure. A spring extends longitudinally through a portion of the pole lower segment while a threaded shank is joined to the spring at a first end of the shank. The threaded shank and a nut cooperate at a second end of the shank to adjust the tension in the spring. A first socket is fixedly held within the pole lower segment at the top thereof. The first socket includes a lip portion having a rounded generally circular edge which extends beyond the end of the pole lower segment.

The delineator pole also includes an upper segment. A second socket is fixedly held within the pole upper segment at the bottom end thereof. A flange integral with the second socket extends vertically beyond the pole upper segment at its bottom portion. The flange has a circular groove and an opening through which a pivot eye is received. An end of the spring engages the pivot eye to connect the upper and lower pole segments. In the absence of a force being applied to the pole upper segment, the pole lower and upper segments are axially aligned. When a force acts to move the pole upper segment out of axial alignment with the pole lower segment, the coils of the spring extend in a direction substantially coaxial to the longitudinal axis of the pole lower segment. In addition, the rounded edge of the lip portion of the pole lower segment is retained in the groove of the flange of the pole upper segment. Thus, upon release of the force, the cooperation of the grooved flange and the rounded lip portion acts to guide the upper and lower pole segments into axial alignment while the force of the spring provides the impetus to this realignment.

From the foregoing, the advantages of this invention are readily apparent. A delineator pole including a spring bias housed entirely within a segment thereof is provided thereby eliminating the exposure of the spring to possible damaging elements. In addition, the spring is positioned in the pole so that a force against the pole results in the spring extending in a direction substantially coaxial to the longitudinal axis of the pole segment held in the support structure. Unlike pole support structures in which the spring itself bends, the spring bias herein described tends to reduce possible spring distortion due to numerous pole bending forces since the spring essentially does not bend. Furthermore, an improved structure for guiding the pole segments into axial alignment after the release of a force against the pole is provided. The invention of Applicant also provides a weatherproof pole with a capacity for pivoting or moving in the direction of a force non-parallel to the pole which is applied thereagainst. The pole is sufficiently resilient to minimize damage to a body striking the pole while being able to immediately return to the vertical position. Finally, the pole described herein has no exposed irregular or sharp metal parts which may damage or injure the impacting body.

DETAILED DESCRIPTION

Figure 1:
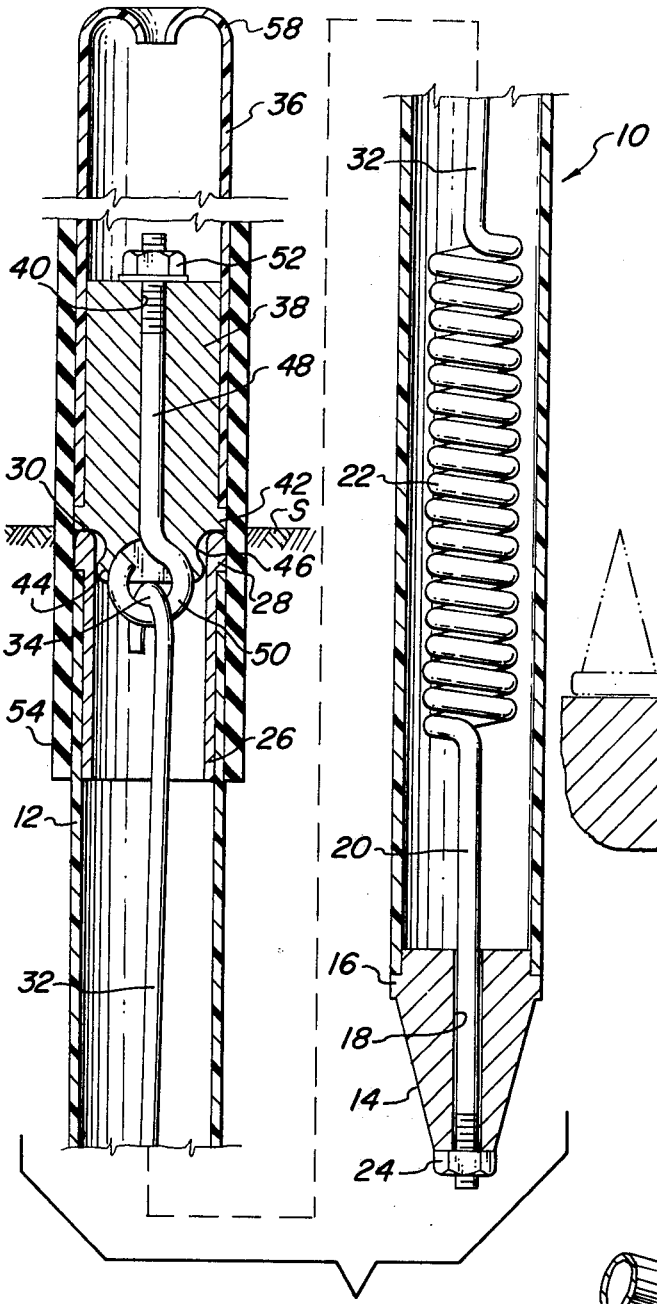
FIG. 1 is a fragmentary, longitudinal, cross-sectional view of the delineator pole of this invention showing the interconnected parts thereof.

Referring to the drawings, an elongated pole 10 is shown held in a support S such as concrete, ground, or snow. The pole 10 is conveniently comprised of a hollow cylindrical tube of light weight, high impact resisting material, such as polycarbonate. A pole lower segment 12 is fixedly held so it is completely surrounded by the support S in a substantially vertical position. A conical tip 14 extends from the bottom end of the pole lower segment 12. A top portion of the concial tip 14 is connected to the inner surface of pole lower segment 12 while a rim 16 of conical tip 14 engagingly surrounds the outer surface of pole lower segment 12. The tapered cone shape of conical tip 14 facilitates the insertion of the pole lower segment 12 into the support S. An aperture 18 is centrally formed in the conical tip and receives a shank 20 therethrough. A first end of shank 20 is integrally joined to a coiled spring 22 which is completely contained within pole lower segment 12 while a second end of shank 20 is threaded to receive a locked nut 24 at the bottom portion of conical tip 14. The term locked nut is used to mean that the nut 24 can be embedded or anchored from rotating in the conical tip 14 so that rotation of upper segment 36 and then spring 22 can be used to adjust the tension of the spring. The length of the threaded second end of shank 20 which extends beyond the conical tip 14 can be varied so that, in cooperation with the locked nut 24, the amount of tension in the spring can be adjusted, as described above. A hollow first or female socket 26 is held contiguous with the inner surface of the top portion of pole lower segment 12. First socket 26 also includes a lip portion 28 which extends vertically, outwardly beyond the pole lower segment 12. Lip portion 28 has a generally circular rounded edge 30. A rod 32 having a hooked end 34 is integral with spring 22. Hooked end 34 is positioned within the first socket 26.

Pole 10 further includes a pole upper segment 36 which is shown in FIG. 1 is axially aligned with pole lower segment 12. A second or male socket 38 having an opening 40 is held contiguous with the inner surface of pole upper segment 36. Second socket 38 is of substantially the same lateral cross-sectional size as first socket 26 and includes a lip portion 42 which extends vertically, outwardly beyond pole upper segment 36. A flange 44 having a rounded groove 46 is integral with the top surface of the lip portion 42. An eye bolt 48 having a pivot eye 50 is inserted through the slotted end of opening 40 and held by a fastening nut 52. Pivot eye 50 extends beyond the slot in flange 44 and is grippingly engaged by hooked end 34 of rod 32. The interconnection of pivot eye 50 and hooked end 34 results in the contiguous joining of rounded edge 30 of lip portion 28 of pole lower segment 12 and lip portion 42 of pole upper segment 36 while grooved flange 44 is positioned inwardly adjacent rounded edge 30 so that lip portion 42 and rounded edge 30 are concentrically rotatable with respect to each other. The rounded surface of grooved flange 44 has a greater radius than the radius of the rounded edge 30. Also the diameter of flange 44 is slightly less than the inside diameter of the socket 26 to aid in maintaining the components in axial alignment. Lip portion 28 and rounded edge 30 of first socket 26 cooperate with lip portion 42 and grooved flange 44 of second socket 38 to also guide and support the pole lower segment 12 and retain the pole upper segment 36 in axial alignment. Consequently, when pole lower segment 12 is completely contained in support S, pole upper segment 36 extends vertically beyond and is axially aligned with pole lower segment 12 as long as no sufficiently strong force acts to misalign the pole segments.

Outwardly adjacent the pole break-over area where pole lower segment 12 and pole upper segment 36 join together, is an elastic, protective, water-proof sleeve 54 which prevents the entry of water, snow, dirt, and any other foreign material into the pole 10. The polycarbonate pole 10 extends vertically beyond the break-over or joining area of the pole segments for a convenient distance depending on the particular use to be made of the pole 10, for example, a road traffic sign support or a slalom snow ski gate indicator. Overlying the top of the pole upper segment 36 or closed end can be a cap 58 which completes the enclosing of the pole 10 so that unwanted elements are restricted from penetrating into the interior of pole 10.

Figure 2:
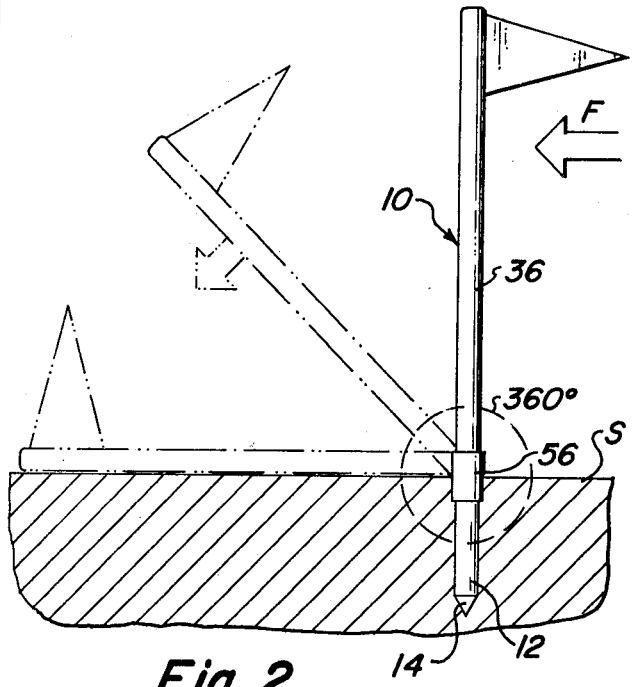
FIG. 2 is a side elevational view of the pole illustrating its pivoting action.
Figure 3:
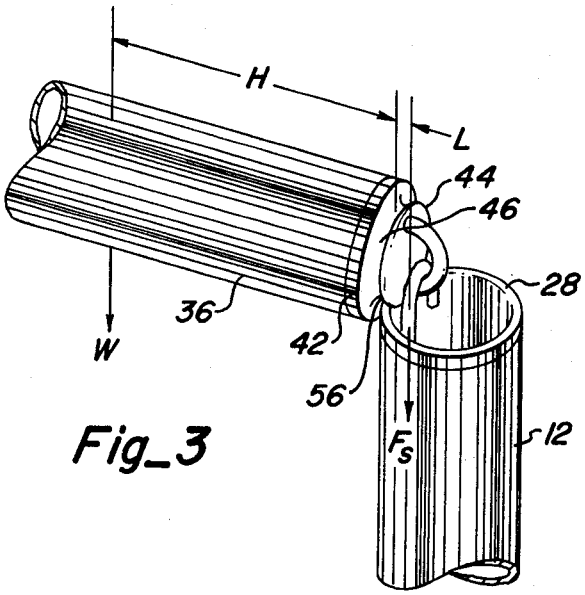
FIG. 3 is a fragmentary perspective detailed view of the interconnection of the pole upper and lower segments.

When an impacting force F of sufficient magnitude, as illustrated in FIG. 2, acts against the pole upper segment 36, it pivots downwardly toward the support S while the pole lower segment 12 remains stationary. Since pole upper segment 36 pivots or tilts in any direction through an arc of 360°, force F may be from any direction to cause the moving or pivoting of pole upper segment 36. As the pole upper segment 36 pivots or tilts and thereby moves out of axial alignment with pole lower segment 12, portions of the rounded edge 30 move out of contact with lip portion 42 of second socket 38. But, as seen in FIG. 3, other portions of rounded edge 30 contact groove 46 of flange 44 so that, even when pole upper segment 36 is substantially level with support S and, consequently, generally perpendicular to pole lower segment 12, portions of rounded edge 30 of lip portion 28 remain hooked or retained in groove 46. At the same time that the pole upper segment 36 begins to pivot, the spring 22 is pulled substantially vertical along the longitudinal axis of pole lower segment 12, in the direction of pole upper segment 36. When the impacting force is released, the increased tension in spring 22 causes the spring 22 to move substantially vertical again in a direction toward the bottom of pole lower segment 12 thereby pulling on the pole upper segment 36 through pivot eye 50. Concurrently, the cooperation of the rounded edge 30 and the rounded groove 46 guides and returns the pole upper segment 36 back into axial alignment with pole lower segment 12 so that pole upper segment 36 is once again directly contacting pole lower segment 12. It can be appreciated that the interaction of the rounded edge 30 within groove 46 and the circumferential curve of the two parts prevents the sideways separation or the moving out of complete contact of pole upper segment 36 from pole lower segment 12 so that the return of pole upper segment 36 to its original aligned position upon release of the impacting force is readily facilitated.

An additional salient feature of the pivoting action is that flange 44 maintains hooked end 34 spaced from circular lip portion 28 so that pole upper segment 36 freely pivots when a force is applied and hooked end 34 does not bind against rounded edge 30. Furthermore, flange 44 has a generally flat outer surface to minimize further downward motion of the pole upper segment 36 after it has reached a horizontal position, generally perpendicular to the pole lower segment 12.

Another significant facet of the delineator post of this invention is the capability of adjusting the tension in spring 22 as previously discussed. As depicted in FIG. 3, when pole upper segment 36 is substantially perpendicular to pole lower segment 12, its weight W acts as a downward force at a distance H along the pole upper segment 36. The force $F_S$ in spring 22 required to axially align pole upper segment 36 with pole lower segment 12 is given by the formula $F_S = W \times H/L$. L represents the length from the fulcrum 56 to the application of the spring force $F_S$ where the hooked end 34 engages pivot eye 50. For example, when L is 0.35 centimeters and H is 180 centimeters, the force exerted by the spring must be over 500 times the weight of the pole and any attachments thereto. Thus, it is evident that a small variation in weight, as for instance by substituting a metal sign for a flag on the upper end of the pole 10 will have a great effect on the force required to vertically align the pole and this is obviously due to the relatively short distance L. Since to increase the distance L would require increasing the diameter of the pole and thus necessarily its total weight, the ability to adjust the force applied by the spring 22 is an important and practical answer to balancing these forces.

A related feature becomes apparent, upon manipulation of the above-provided mathematical formula, to determine the magnitude of the force necessary to pivot pole upper segment 36 out of alignment with pole lower segment 12. Replacing the factor W with an impacting force acting against pole upper segment 36, it is apparent that the impacting force must be at least greater than $F_S \times L/H$ in order to pivot or move pole upper segment 36. As shown in FIG. 3, the distance L is substantially at a minimum distance from the fulcrum 56 so that the impacting force required to pivot pole upper segment 36 is accordingly minimized. If the force W applied to the pole upper segment 36 is moved 90° with respect to the plane of the eye 50 from that shown in FIG. 3 so that hook 34 is held further away from flange 44 substantially at the top portion of pivot eye 50, the distance L is essentially maximized and the impacting force necessary to pivot pole upper segment 36 is increased. Thus, depending on the use to be made of the pole 10, the required magnitude of the impacting force necessary to pivot pole upper segment 36 can vary accordingly.

Based on the foregoing, the advantages of this invention are easily discerned. Upper and lower segments of a delineator pole are pivotably joined to facilitate the pivoting thereof as well as guiding the segments during tilting and to axially align the parts after the removal of an impacting force. The coil spring is wholly contained within the lower segment which is fixedly held in a support structure so that the spring itself does not bend to minimize the tension deterioration thereof. Furthermore, the spring tension can be adjusted so that the pole can be used with various types of indicators from relatively heavy weighted traffic signs to substantially light weight flags for use as slalom poles. Finally, the pole of this invention is weather-proof, capable of pivoting in any direction, and comprised of parts which minimize damage to a body upon impact.

While a tension spring has been described herein for illustration purposes, it is to be understood that any type of biasing device can be used to bias the upper segment 36 into alignment with the lower segment 12. Thus, it is possible to have a compression spring (not shown) provided in the lower segment 12 wherein the upper end of the spring is placed in position against the bottom edge of first socket 26 with a rod passing downwardly within the spring. The lower end of the rod can be threaded to be held in position by a washer and lock nut positioned at the lower end of the spring. The washer and nut may be securely fastened to the lower end of the spring and the upper end secured to the socket 26. In this way, the turning of the upper segment 36 causes the eye bolt 48 to rotate which in turn causes the rod to also rotate with respect to the lock nut and spring. Thus, turning the upper segment 36 with respect to the lower segment 12 allows the stress on the rod to be variably adjusted.

Although two different arrangements for positioning of the spring have been described, it is to be understood that any arrangement desirable which will provide the necessary tension in aligning the two segments through the coupling section can be provided for this invention. This is to say that even the arrangements shown can be reversed if desired, such as placing the spring in the upper segment with the eye bolt and socket in the lower.

It is also to be understood that the pole lower segment 12 can be inserted in a removable sheath which in turn can be embedded or inserted into the support S. Wings or outwardly extending flanges or plates can be attached to the outer surface of either the lower segment of the pole or the sheath, if used, to prevent unintentional rotation of pole during use.

The invention has been described in detail with particular reference to a specific embodiment thereof, but it will be understood that variations and modifications can be effected within the spirit and scope of this invention.

I claim:

1. A delineator post held in position by a support structure and which pivots due to an impacting force from any direction, said post comprising:

an elongated, hollow pole lower segment having a first and second end and held in the support structure;

a tip portion having an opening and extending vertically beyond said first end of said pole lower segment while connected to an inner surface of said pole lower segment, said tip portion facilitating the insertion of said pole lower segment into the support structure;

spring means having a first and second end and contained completely within said pole lower segment;

a shank having a frist and second end, said shank first end connected to said first end of said spring means and said shank second end threadedly inserted through said tip portion opening so that the amount of tension in said spring means can be adjusted;

locking means for securing said shank second end in said tip portion opening;

a rod having a hooked end and being connected to said second end of said spring means;

a first socket fixedly held contiguous with the inner surface of said pole lower segment adjacent said second end thereof and having a hollow center portion and a peripheral lip portion with a rounded edge extending vertically beyond said pole lower segment;

a pole upper segment having a first and second end and being axially alignable with said pole lower segment;

a second socket having an opening and fixedly held contiguous with an inner surface of said pole upper segment adjacent said first end thereof and having a protruding center portion extending beyond said pole so as to be inserted within said hollow portion of said first socket;

said protruding center portion having a flanged outer circumferential edge and a concave groove on the side of the flange which will contact said lip;

an eye bolt fixedly held through said second socket opening and having a pivot eye inserted through said flange slot to engage said hooked end of said rod and thereby operably connect said pole upper segment to said pole lower segment;

whereby, upon application of a force of sufficient magnitude against said pole upper segment, said pole upper segment pivots away from axial alignment with said pole lower segment and said spring means extends substantially coaxial with the longitudinal axis of said pole lower segment while portions of said rounded edge slidably hook against said concave groove of said flange to retain contact between the segments so that upon release of said force, said rounded edge of said first socket and said grooved flange of said second socket cooperate to connect and guide said pole upper segment into axial alignment with said pole lower segment and said spring means returns to its original condition.

2. A delineator post held in position by a support structure and which pivots due to an impacting force from any direction, said post comprising:

a pole having an upper segment and a lower segment axially alignable with said upper segment, said lower segment to be rigidly held in the support structure;

a first socket connected to said pole lower segment and having a hollow center portion and a generally rounded outer peripheral edge;

a second socket connected to said pole upper segment and having a protruding center portion and a circumferential flange integral therewith and a concave groove formed on one side of said flange; and bias means operably connecting said pole lower segment to said pole upper segment so that, when a force of sufficient magnitude is applied to said pole upper segment, said rounded edge of said first socket slidably engages said concave groove of said second socket as said pole upper segment pivots about said pole lower segment which retains the two segments engaged and axially intersectingly aligned while said bias means shifts due to the force, and upon release of the force said rounded edge cooperates with said groove to guide said hollow first socket into contiguous engagement with the protruding portion of said second socket and thereby axilly align said upper and lower pole segments while said bias means returns to its original condition.

3. The post, as claimed in claim 2, wherein:

said pole lower segment includes means for adjusting the amount of bias force in said spring means.

4. The post, as claimed in claim 3, wherein:

said pole lower segment includes a tapered conical tip which extends beyond and is connected to said pole lower segment at the end opposite the end which engages said pole upper segment, said conical tip facilitating the insertion of said pole lower segment through the support structure.

5. The post, as claimed in claim 4, wherein said adjusting means includes:

a shaft having a first end and a second end, said first end connected to said spring means and said second end inserted through an opening in said conical tip the length of said second end of said shaft through said conical tip being variable to adjust the amount of spring tension; and locking means threadedly attached to said second end of said shaft and fixedly attached to said conical tip to maintain the tension in said spring means.

* * * * *